US005147211A

United States Patent [19]

Tondreault et al.

[11] Patent Number: 5,147,211

[45] Date of Patent: Sep. 15, 1992

[54] ELECTRICAL INTERCONNECT DEVICE WITH MODULE EJECTION MEANS

[75] Inventors: Robert J. Tondreault, Louisville, Ky.; Robert W. Rollings, Georgetown; James F. DePriest, New Albany, both of Ind.

[73] Assignee: Robinson Nugent, Inc., New Albany, Ind.

[21] Appl. No.: 725,581

[22] Filed: Jul. 3, 1991

[51] Int. Cl.[5] ..... H01R 13/62

[52] U.S. Cl. ..... 439/160; 439/152

[58] Field of Search ..... 439/152-160

[56] References Cited

U.S. PATENT DOCUMENTS

| | | | |
|---|---|---|---|
| 2,987,693 | 6/1961 | Wamsley . | |
| 3,150,906 | 9/1964 | Chambon et al. . | |
| 3,853,379 | 12/1974 | Goodman et al. . | |
| 4,057,879 | 11/1977 | Eigenbrode . | |
| 4,070,081 | 1/1978 | Takahashi . | |
| 4,075,444 | 2/1978 | Hollingsead et al. . | |
| 4,582,378 | 4/1986 | Fruchard | 439/157 |
| 4,836,790 | 6/1989 | Narita | 439/159 |
| 4,990,097 | 2/1991 | Billman et al. . | |
| 5,013,264 | 5/1991 | Tondreault . | |
| 5,057,029 | 10/1991 | Noorily | 439/157 |

*Primary Examiner*—David L. Pirlot

*Attorney, Agent, or Firm*—Barnes & Thornburg

[57] ABSTRACT

An electrical interconnect device includes an elongated socket for releasably holding a module in an engaged position therein and an ejector for ejecting at least a portion of the module from the socket. The device also includes a lever arm for rotating the module ejector means about an axis of rotation extending in the direction of elongation of the socket to move the module ejector against a module held in the socket. This action causes at least a portion of the module to be disengaged from the socket means to enable a user to extract the module from the socket means. The rotatably actuated module ejector is mounted on the device to lie between two modules that are held in side-by-side relation in the socket. The lever arm is pivotable about an axis of rotation either in a clockwise or counterclockwise direction to permit a technician to remove more than one module from the socket.

47 Claims, 2 Drawing Sheets

ELECTRICAL INTERCONNECT DEVICE WITH MODULE EJECTION MEANS

BACKGROUND AND SUMMARY OF THE INVENTION

This invention relates to electrical interconnect devices, and particularly to electrical connectors including module extraction apparatus. More particularly, the invention relates to an electrical connector including means for ejecting one or more modules attached to the electrical connector.

An electrical interconnect device is a useful tool for connecting electrical components to one another. Typically, an electrical interconnect device will include a socket for holding and retaining one or more modules therein so that the modules are coupled electrically, for instance, to a printed circuit board. A module is typically any electrical component, package, or edge card having contacts that can be inserted into the socket provided by the electrical interconnect device. An edge card is a variety of printed circuit board that can be mounted in a socket. The socket mechanically holds a module in place in an interconnect device and provides an electrically conductive path so that the module can be connected electrically to a printed circuit board.

One problem with conventional electrical connectors is that it is often difficult to extract a module that is held in the socket formed in the electrical connector. It will be understood that modules are often socketed close to one another on an electrical connector in tight quarters, making it hard for a technician to pry a selected module out of the connector socket manually by hand or using a tool. A delicate module can be damaged easily during extraction by rough handling if means is not available to permit a user to remove the module consistently with minimum effort.

Another problem is that it is often difficult to remove a module which has many contacts engaging a connector socket and spreading out over a large area. These large modules must be replaced from time to time and an apparatus configured to help a technician extract such large modules from a connector socket without damaging either the module itself or neighboring modules would be useful.

It is known to provide an electrical connector with module extraction apparatus. See, for example, U.S. Pat. No. 4,990,097 to Billman et al. wherein a handle on the connector can be lifted to permit a circuit panel member to be withdrawn from a socket and U.S. Pat. No. 4,070,081 to Takahashi wherein swinging lifting levers are provided for prying a module upwardly out of a socket. See also U.S. Pat. No. 2,987,693 to Wamsley.

It has been observed that technicians often find it a difficult task to grip a handle of the type disclosed in the Billman et al. '097 patent using their fingers to actuate the extraction device. This is especially true if the socket is nestled in close proximity to other components or devices. It will be understood that, in many cases, a great deal of lifting force must be applied by a technician to a socketed module to extract it from a socket and that the fingers of a technician could be hurt during manual module extraction activities. Of course, such a lifting force problem is made worse if the module to be extracted has many socket-engaging contact spreading out over a large area of the socket. The Takahashi '081 levers provide more mechanical advantage, but take up space which is not always available in a high-density system. The Wamsley '693 lever assembly is not a part of the socket itself and is mounted on a plate separated from the socket.

According to the present invention, an electrical interconnect device includes an elongated socket including means for releasably holding a module in an engaged position therein and means for ejecting at least a portion of the module from the holding means. The device also includes means for rotating the ejecting means about an axis of rotation extending in the direction of elongation of the socket to move the ejecting means against a module held in the socket means. This action causes at least a portion of the module to be disengaged from the socket means to enable a user to extract the module from the socket means.

In preferred embodiments, the ejecting means is a half-moon-shaped cam member and the rotating means includes a lever arm having a hand grip at one end and a pivot post coupled to the other end. The pivot post extends through a channel formed in the socket to connect to the cam member. The pivot post is rotatable in the channel about the central axis of the pivot post.

In use, the lever arm is pivoted by a technician to rotate about the axis of rotation of the pivot post to cause a module to be extracted from the socket. The lever arm is used to rotate the pivot post in the channel formed in the socket to cause the cam member to rotate and urge a module held in the holding means out of engagement with the holding means to enable a user to extract the module from the socket.

One feature of the improved electrical interconnect device is that it is provided with a compact rotatably actuated module ejection assembly The cam member and the lever arm rotate about the axis of rotation established by the pivot post To assist in extracting a socketed module, a great deal of leverage is generated by use of a lever arm that is pivotable to rotate a cam member to a position disengaging a module from a socketed position in a connector socket. This provides a very simple and natural motion to a technician assigned to manually remove either large or small modules from a connector socket. Due to the lever arm advantage, the force required to eject a module from the connector socket is relatively low. This is true even if the module to be extracted has many socket-engaging contacts spreading out over a large area on the socket. One advantage of this feature is that resultant forces during actuation act to keep the interconnect device securely coupled to the underlying printed circuit board instead of tending to pull the device away from the printed circuit board. In addition, the lever arm is coupled to the socket to pivot about an axis that extends in the direction of elongation of the socket to provide a compact module ejector assembly on the socket.

Another feature of the present invention is that the rotatably actuated module ejection assembly is mounted on an electrical connector to lie between two modules that are arranged in side-by-side relation and socketed to the connector. The ejection assembly includes a lever arm mounted to an electrical connector and coupled to a cam member as described above. The lever arm is pivotable about an axis of rotation either in a clockwise direction to move the cam member in one direction to eject the first modules from engagement with its connector socket or in a counterclockwise direction to move the cam member in another direction to eject the second module from engagement with its connector socket. Advantageously, a single pivotable lever arm and cam assembly is operable to permit a technician to remove more than one socketed module from an electrical connector.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
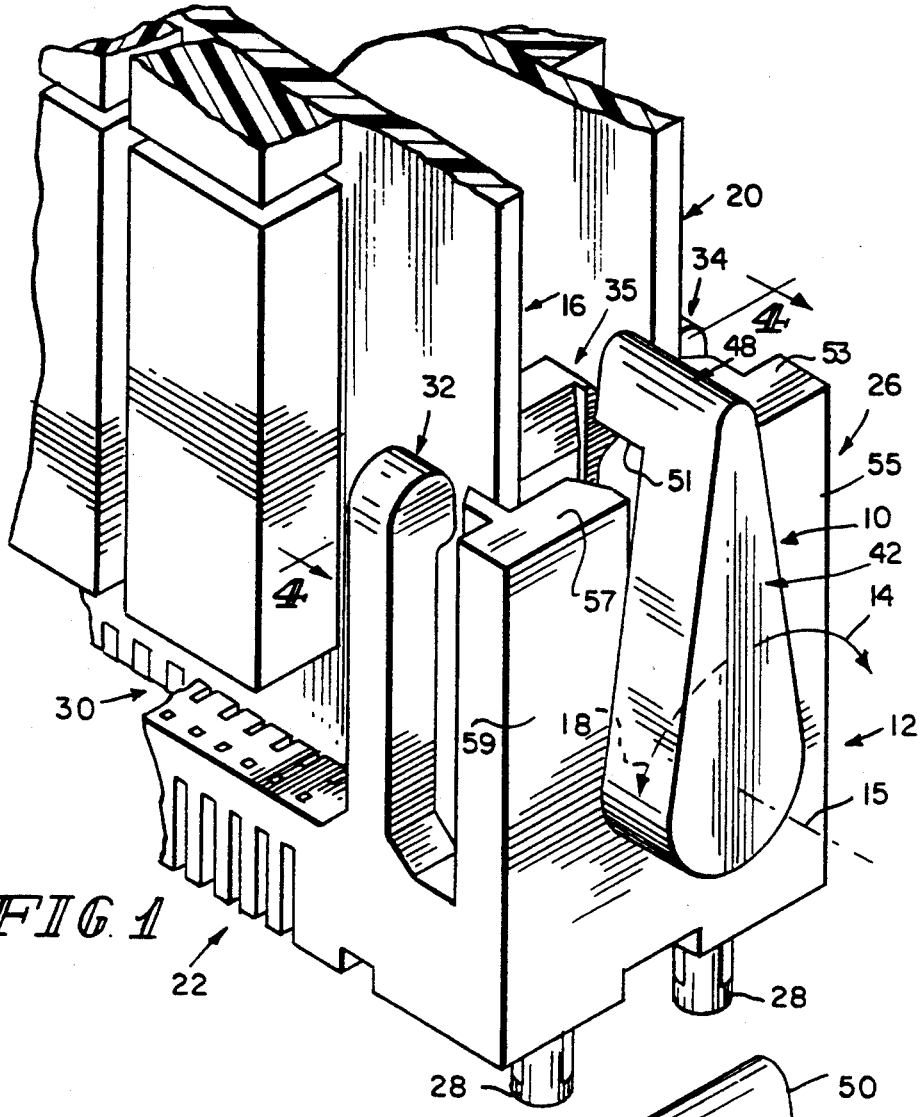
FIG. 1 is a perspective view showing two modules socketed in the base of an electrical connector and arranged to lie in side-by-side relation and a rotatably actuated module ejector assembly mounted for rotation to an end piece of the electrical connector.

Referring to FIG. 1, a module ejector assembly 10 is mounted to an electrical connector 12 and operable to rotate in a first direction 14 about axis of rotation 15 to eject a first module 16 from a socketed position in electrical connector 12. The module ejector assembly 10 is alternately rotatable about axis of rotation 15 in an opposite direction 18 to disengage at least a portion of a second module 20 from its socketed position in electrical connector 12. Advantageously, electrical connector 12 will function with or without module ejector assembly 10. When required, the electrical connector 12 is designed so that the ejector assembly 10 can easily be "snapped" into position in the electrical connector 12 when loaded, for example, from the top of the connector 12.

Figure 3:
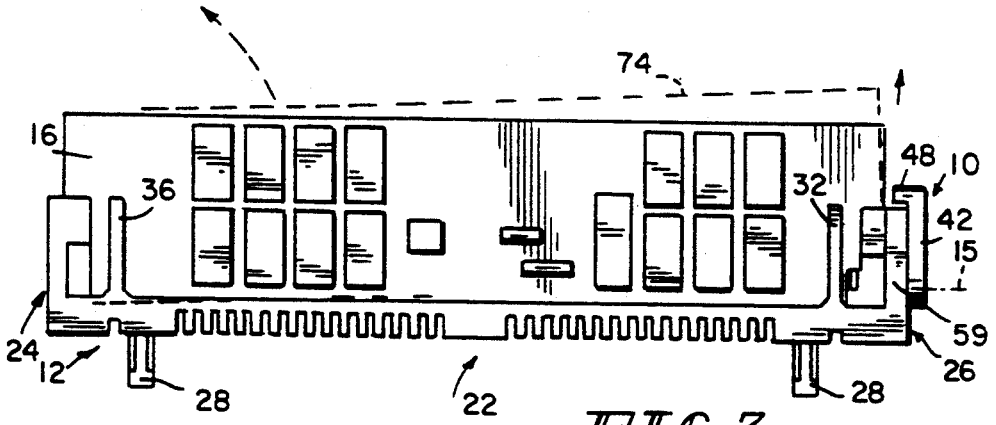
FIG. 3 is a side elevation view of a module socketed in an electrical connector showing the location of a module ejector assembly at one end of the electrical connector and showing in phantom lines the location of the module following rotation of the module ejector assembly to disengage a portion of the module from its socketed position in the electrical connector.

Referring to FIGS. 1 and 3, an electrical connector includes a base 22 and first and second end pieces 24, 26 formed at opposite ends of the base 22. A plurality of polarization plugs 28 are provided on the bottom of base 22 to permit base 22 to be mounted to a printed circuit board or other apparatus (not shown). The base 22 is formed to include an upwardly opening first socket chamber 30 for receiving and retaining module 16 therein and a second socket chamber (not shown) for receiving and retaining the second module 20 therein. It will be understood that a module is an electrical component, edge card, device, or apparatus that can be deposited into a socket chamber such as chamber 30 and held in mechanically and electrically coupled relation to the electrical connector.

Figure 2:
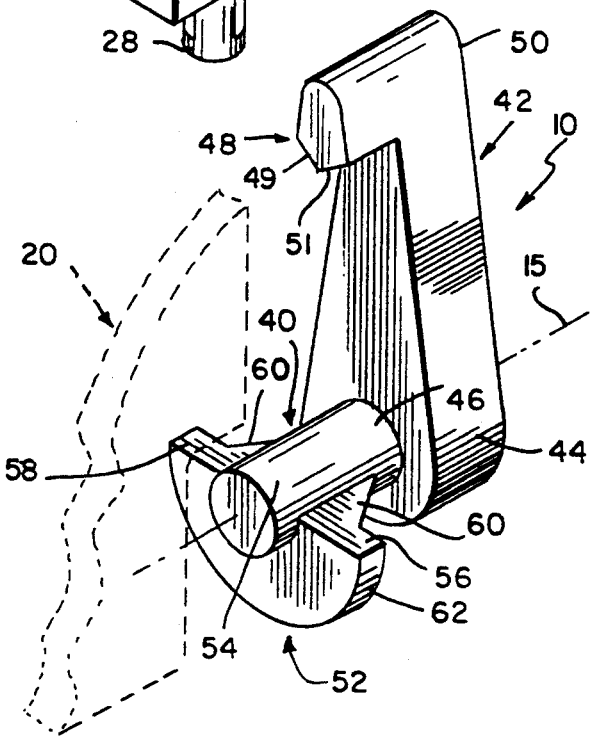
FIG. 2 is an enlarged view of the rotatably actuated module ejector assembly illustrated in FIG. 1 showing a lever arm, pivot post, and a cam member included in the ejector assembly and a module portion shown in phantom lines and arranged to be ejected from an electrical connector socket by the cam member upon pivoting movement of the lever arm with respect to the electrical connector about an axis of rotation.

A first external beam 32 is appended to the connector base 22 as shown in FIGS. 1 and 2 and arranged to extend upwardly in spaced-apart relation to the end piece 26 to provide means for stabilizing module 16 in an upright position while retained in socket chamber 30. Likewise, a second external beam 34 is appended to connector base 22 as shown in FIG. 1 and arranged in spaced-apart relation to the opposite side of end piece 6 to extend upwardly and engage the second module 20 to support second module 20 in a stable upright position while it is received in its socket chamber (not shown) formed in connector base 20. An internal member 35 is provided on connector 12 between the first and second socket chambers and configured to engage and support the opposing inner facing walls of the first and second modules 16, 20 as shown in FIG. 1.

Another external stabilizing beam like beam 32 is provided in close proximity to the opposite end piece 24 as shown in FIG. 3 to stabilize the other end of module 16. Likewise, another external stabilizing beam (not shown) is provided to stabilize the opposite end of the second module 20 while module 20 is socketed in connector base 22. A second internal member (not shown) is provided to help support the modules 16, 20 in upright positions in the socket.

The configuration of the module ejector assembly 10 is shown in detail in FIG. 2. The assembly 10 includes a pivot post 40 that extends through a channel formed in end piece 26 and is snapped into position and supported for rotation about axis of rotation 15. Conveniently, the ejector assembly 40 is mounted for rotation on end piece 26 by moving pivot post 40 downwardly through vertical slot 41 until it snaps into the channel formed at the bottom of slot 41. Once snapped in place, the ejector assembly 10 is free to rotate about axis of rotation 15.

The assembly 10 also includes a pivotable lever arm 42 having a proximal end 44 coupled to the outer end 46 of pivot post 40 and a grip handle 48 formed at the distal end 50 of lever arm 42. A half moon-shaped cam member 52 is appended to an inner end 54 of the pivot post 40 so that its center point is coincident with the axis of rotation 15 of pivot post 40. The cam member 52 includes a first ejector flange 56 for ejecting module 16 from a socketed position in connector base 22 and a second ejector flange 58 for ejecting second module 20 from a socketed position in connector base 22. Advantageously, the ejector assembly 10 includes two ejector flanges 56 and 58 and is thus operable to eject two modules from an electrical connector one at a time.

Figure 6:
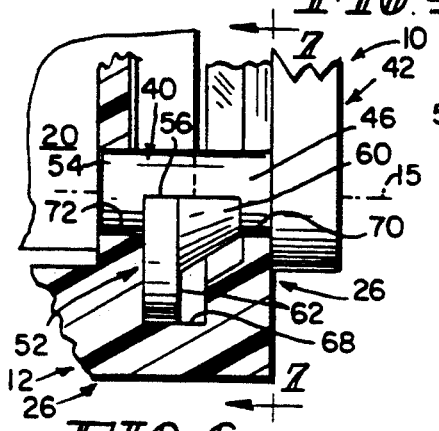
FIG. 6 is a sectional view taken along lines 6—6 of FIG. 4 showing the manner in which the module ejector assembly is mounted for rotation in various channels and grooves provided in the end piece of the electrical connector.
Figure 7:
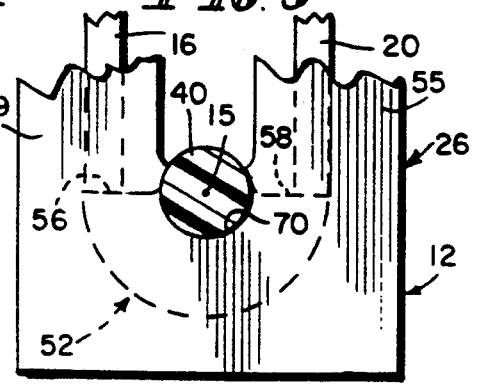
FIG. 7 is a sectional view taken along lines 7—7 of FIG. 6 showing the manner in which the pivot post is supported in a channel formed in the end piece to permit rotation of the pivot post and the cam member relative to the electrical connector.
Figure 1:
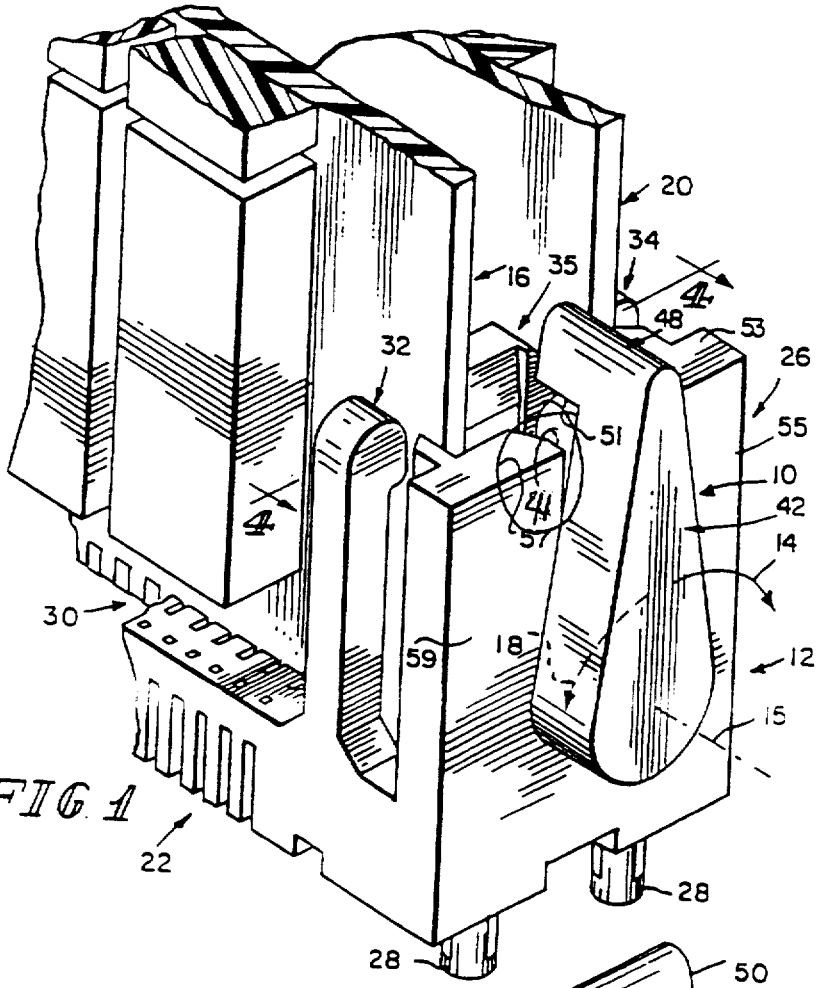
Figure 2:
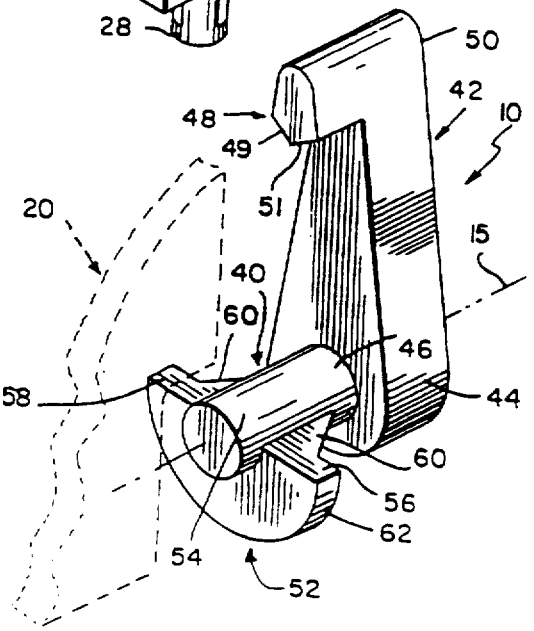
Figure 3:
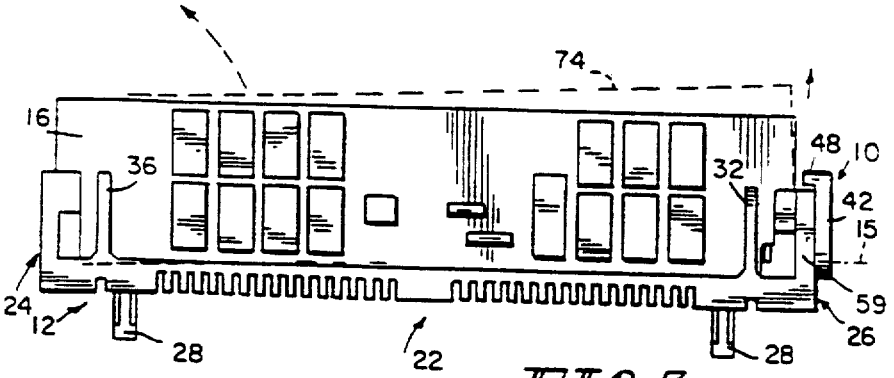
Figure 4:
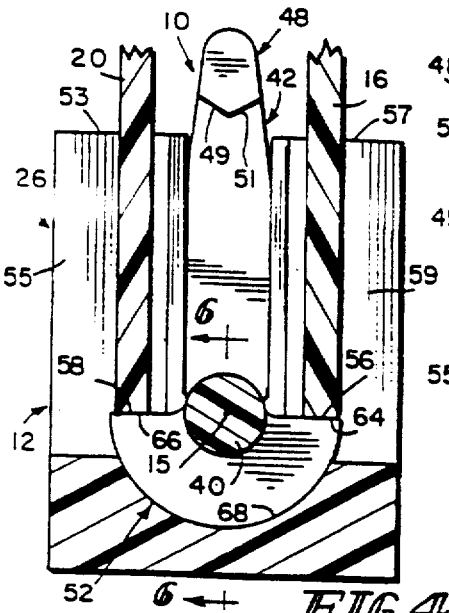
Figure 5:
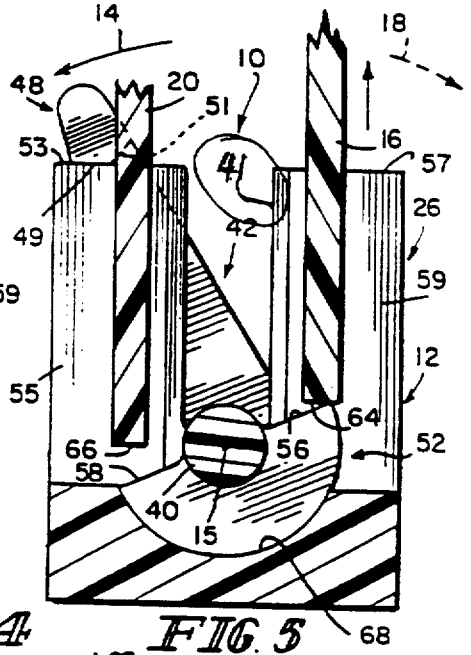
Figure 6:
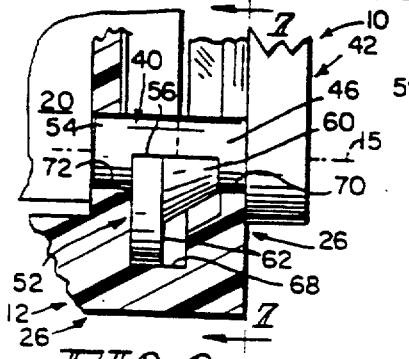
Figure 7:
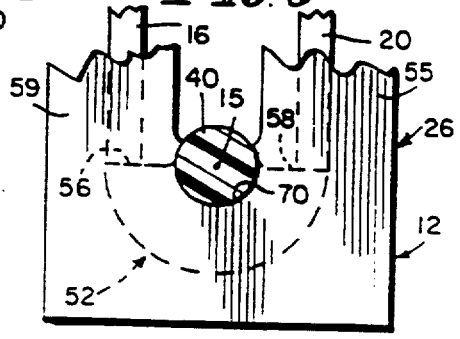

A conically shaped support web 60 extends from a flat face 62 of cam member 52 upwardly and outwardly to mate with a central portion of pivot post 40. Web 60 provides means for supporting cam member 52 in a rigid relation to pivot post 40 as shown in FIGS. 2 and 6.

The module ejector assembly 10 is preferably configured in the manner shown in FIG. 2 to make it easy to mold or cast the assembly 10 as a one-piece unit. Preferably, the ejector assembly 10 is fabricated by simple injection molding methods using a plastics material. The ejector assembly 10 can also be fabricated as a casting to provide increased strength and durability. It will be understood that support web 60 is configured to have a conical shape to simplify the molding of cam member 52 in addition to providing increased strength and rigidity of the molded module ejector assembly 10. Of course, the lever arm 42, pivot post 40, and cam member 52 could be fabricated using separate parts or subassemblies. This ejector assembly 10 is compact and occupies a very small place on the electrical connector 12. Nevertheless, it provides great ease and comfort to the end use.

Figure 4:
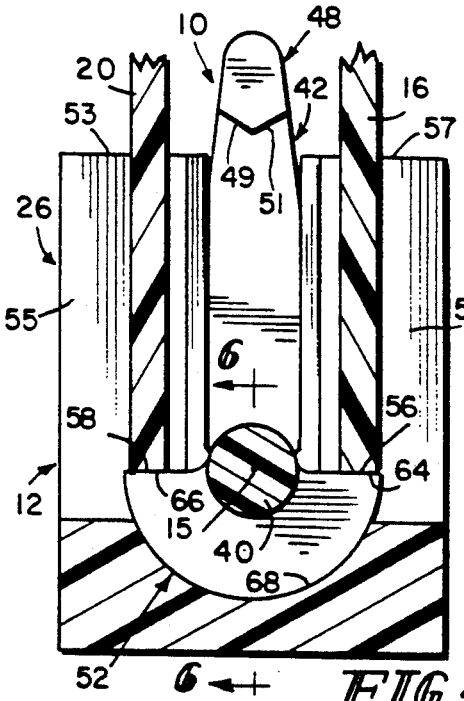
FIG. 4 is a sectional view taken along lines 4—4 of FIG. 1 showing the position of a cam member and two side-by-side modules prior to actuation of the module ejector assembly.
Figure 5:
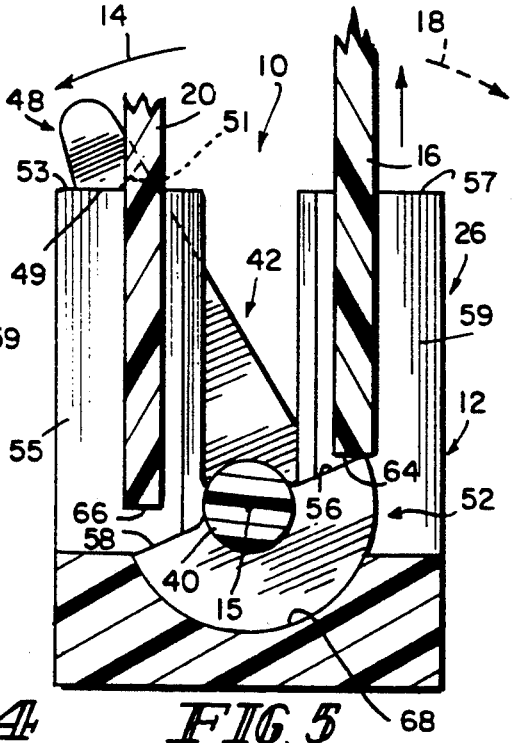
FIG. 5 is a view similar to FIG. 4 showing rotation of the lever arm, pivot post, and cam member in a counterclockwise direction about the axis of rotation to disengage one of the modules from its socketed position in the electrical connector without disengaging the second module from its socketed position in the electrical connector.

The innovative manner in which rotatable actuated module ejector assembly 10 is used to eject one or the other of modules 16 or 20 from a socketed position in electrical connector 12 is illustrated in FIGS. 4 and 5. Initially, both modules 16 and 20 are received in their respective socket chambers in electrical connector 12 and the module ejector assembly 10 is rotated about axis of rotation 15 to assume an inactive, upright, vertical orientation as shown in FIG. 4. In this lower edge 64 of module 16 and the second ejector flange 58 on cam member 52 abuts against a lower edge 66 on module 20. A contoured channel 68 is formed in connector base 22 as shown in FIGS. 4–6 to support the half moon-shaped cam member 52 for rotation about axis of rotation 15. As shown in FIG. 6, the end piece 26 of electrical connector 12 is also formed to include a first channel 70 for rotatably supporting the outer end 46 of pivot post 40 and an inner channel 72 for rotatably supporting the inner end 54 of pivot post 40.

The first module 16 is extracted easily from electrical connector 22 using the module ejector in the following manner. A technician simply grips lever arm 42 at grip handle 48 and pivots lever arm 42 about axis of rotation 15 in direction 14 to cause the entire module ejector assembly 10 to rotate about pivot axis 15 so that the first ejector flange 56 on cam member 52 moves upwardly against the lower edge 64 of module 16. Sufficient pivoting movement of lever arm 42 (e.g., about 30° from the vertical) will cause at least a portion of the lower edge of module 16 to disengage from its socketed position in socket chamber 30 to release the module 16 to the position shown in phantom at 74 in FIG. 3. A technician may now easily extract the module 16 from the electrical connector to permit repair or replacement of that module in the electrical connector The vertical lever arm 42 of the ejector assembly 10 includes a grip handle 48 which serves as the actuation surface for the end user. This grip handle 48 provides a horizontal extension on the vertical lever arm 42 which stretches over the top of the socket on the electrical connector 12. Its length provides a large surface area on which the end user would grip to actuate the ejector assembly 10. This large surface area reduces the force per square inch that must be applied to eject a module for connector 12, thereby minimizing any pain that might otherwise be sensed by the end user.

As shown in FIG. 5, this grip handle 48 also includes a pair of flat stop surfaces 49, 51. Stop surface 49 engages the top wall 53 of column 55 on end piece 26 to provide a positive stop to limit rotation of lever arm 42 in direction 14. Essentially, the grip handle 48 "bottoms out" on the top wall 53 of end piece 26. Such bottoming out notifies the user of a completed ejection process and also prevents over-actuation of the module ejector assembly 10. Likewise, grip handle 48 also includes a stop surface 51 which engages the top wall 57 of column 59 on end piece 26 to provide a positive stop to limit rotation of lever arm 42 in direction 18.

Advantageously, no extra room is required beyond the end piece 26 of the electrical connector 12 for a user to orient his or her finger next to the connector in a proper position to operate module ejector assembly 10 owing to the fact that the location of the grip handle 48 above the connector 12 makes it unnecessary for a user to insert a finger alongside the connector 12. The user's finger can move downwardly toward the top of the connector 12 to reach and actuate the module ejector assembly 10. This is an improvement over connectors 12 having an ejector which can only be actuated by means of a finger placed alongside the end of the connector 12.

Referring again to FIG. 5, it will be seen that at the same time the lever arm 42 is rotated in direction 14 to eject module 16, the second ejector flange 58 on cam member 52 is rotated about axis of rotation 15 away from the lower edge 66 of the second module 20. Thus, the lever arm 42 can be pivoted to eject module 16 without upsetting the socketed connection of module 20 in electrical connector 12. Alternatively, lever arm 42 could be rotated about axis of rotation 15 in the opposite direction 18 (e.g., about 30° from the vertical) to eject module 20 from its socketed position in electrical connector 12. Thus, module ejector assembly 10 is operable to eject in sequence two modules from a connector.

Although the invention has been described in detail with reference to certain preferred embodiments and specific examples, variations and modifications exist within the scope and spirit of the invention as described and defined in the following claims.

What is claimed is:

1. An electrical interconnect device comprising an elongated socket including means for releasably holding first and second modules in engaged positions, means for ejecting at least a portion of the first and second modules from the holding means, and means for rotating the ejecting means about an axis extending in the direction of elongation of the socket to move the ejecting means relative to the socket against a selected module held in the socket so that at least a portion of the selected module is disengaged from the socket to enable a user to extract the selected module from the socket, said ejecting means including a cam member and pivot means mounted on the socket for supporting the cam member for rotation on the socket about said axis, the rotating means including a lever arm coupled to the pivot means, the lever arm being pivotable about the pivot means in a clockwise direction between an inactive position and a first module-ejecting position to eject the first module from the holding means and in a counterclockwise direction between the inactive position and a second module-ejecting position to eject the second module from the holding means.

2. The device of claim 1, wherein the socket includes a vertical end piece and the lever arm has a proximal portion coupled to the pivot means to locate the end piece between the holding means and the lever arm, and a distal portion formed to provide a grip handle.

3. The device of claim 1, wherein the socket includes a base formed to include a module-receiving cavity and an end piece formed to include means for retaining a module held in the module-receiving cavity in a predetermined position and the pivot means lies in a channel formed in the end piece.

4. The device of claim 3, wherein the lever arm is coupled to the pivot means and the pivot means is situated in the channel formed in the end piece to position the cam member along an inside wall of the end piece adjacent to the base and the lever arm along an outside wall of the end piece so that the end piece lies between the lever arm and the first and second modules deposited in the first and second module-receiving cavities formed in the base.

5. The device of claim 3, wherein the lever arm is coupled to the pivot means and a stop member is appended to the lever arm and position to engage the end piece to limit pivoting movement of the lever arm about said axis.

6. The device of claim 1, wherein the lever arm is coupled to the cam member, the rotating means including means for connecting the lever arm to the pivot means to position the cam member adjacent the first and second modules held in an engaged position in the holding means so that rotation of the lever arm relative to the socket moves the cam member against the selected module to disengage said selected module from the holding means of the socket.

7. The device of claim 6, wherein the socket includes a base formed to include first and second module-receiving cavities and an end piece appended to the base and situated in spaced-apart relation to the first and second modules socketed in the first and second module-receiving cavities, the mounting means includes a pivot post arranged to extend through an aperture formed in the end piece and configured to rotate in said aperture, the pivot post includes an interior end located on one side of the end piece in close proximity to the first and second module-receiving cavities and an exterior end located on the opposite side of the end piece, said cam member being mounted on the interior end of the pivot post.

8. The device of claim 7, wherein the lever arm is coupled to the exterior end of the pivot post and a stop member appended to the lever arm and positioned to engage the end piece to limit pivoting movement of the lever arm about the axis of rotation of the pivot post.

9. An electrical interconnect device comprising a socket including a base formed to include a first elongated module-receiving cavity, an adjacent second elongated module-receiving cavity, an integral upstanding end piece on one end of the base, a lever arm, a cam member appended to the lever arm, and means for pivotably mounting the lever arm on the integral upstanding end piece for movement about a pivot axis extending in the direction of elongated of the first and second module-receiving cavities so that the cam member moves along a path to engage and eject, selectively, either the first module held in the first module-receiving cavity or the second module held in the second module-receiving cavity, the cam member including a first flange configured to eject the first module held in the first module-receiving cavity in response to pivoting movement of the lever arm in a clockwise direction about the axis of rotation and a second flange configured to eject the second module held in an adjacent of module-receiving cavity in response to pivoting movement of the lever arm in a counterclockwise direction about the axis of rotation.

10. The device of claim 9, wherein the integral upstanding end piece is situated to lie between the first and second module-receiving cavities and the movable lever arm.

11. An electrical interconnect device comprising an elongated socket including means for holding at least one module and a curved cam support surface, a cam member, a lever arm coupled to the cam member, and means for coupling the lever arm to the socket so that the lever arm is rotatable in a first plane about an axis of rotation extending in the direction of elongation of the socket to move the cam member in a second plane spaced apart from the first plane against a module from the socket, the cam member including an ejector flange configured to engage a module socketed in the holding means in response to rotation of the lever arm about its axis of rotation and means for riding on the curved cam support surface during rotation of the lever arm about its axis of rotation to stabilize the cam member relative to the socket during rotation of the lever arm to eject a module socketed in the holding means.

12. The device of claim 11, further comprising a stop member appended to the lever arm and positioned to engage the socket to limit rotating movement of the lever arm about the axis of rotation.

13. The device of claim 11, wherein the socket including a base formed to include a module-receiving cavity and an end piece integrally appended to the base, and the coupling means is coupled to the end piece.

14. The device of claim 11, wherein the socket is formed to include a channel and the coupling means includes a pivot post situated in the channel to lie in rotative bearing engagement with the socket.

15. The device of claim 14, wherein the socket includes a base formed to include the holding means, an end piece integrally appended to the base and formed to include the channel, and the pivot post is in rotative bearing engagement with the end piece in the channel.

16. The device of claim 15, further comprising a stop member appended to the lever arm and positioned to engage the end piece to limit rotating movement of the lever arm about the axis of rotation.

17. An electrical interconnect device comprising an elongated socket including means for holding first and second modules, a cam member, a lever arm coupled to the cam member, and means for coupling the lever arm to the socket so that the lever arm is rotatable in a first plane about an axis of rotation extending in the direction of elongation of the socket to move the cam member in a second plane spaced apart from the first plane selectively against either the first or second module in the holding means to disengage at least a portion of the first or second module from the socket to enable a user to extract the first or second module from the socket, the cam member including first flange means for moving the first module held in the holding means to disengage the first module from the holding means in response to pivoting movement of the lever arm in a clockwise direction about the axis of rotation to a first module-ejecting position and second flange means for moving the second module held in the holding means adjacent to the first module to disengage the second module from the holding means in response to pivoting movement of the lever arm in a counterclockwise direction about the axis of rotation to a second module-ejecting position.

18. An electrical interconnect device comprising a socket including first holding means for holding a first module and second holding means for holding a second module, means for ejecting the first module from the first holding means and the second module from the second holding means, means for rotating the ejecting means about an axis of rotation in one of a clockwise direction relative to the socket against the first module socketed in the first holding means so that at least a portion of the first module is disengaged from the first holding means and a counterclockwise direction relative to the socket against the second module socketed in the second holding means so that at least a portion of the second module is disengaged from the second holding means.

19. The device of claim 18, wherein the rotating means includes a lever arm pivotably mounted on the socket for movement about the axis of rotation between an inactive position, a first module-ejecting position, and a second module-ejecting position, and the ejecting means is coupled to the lever arm to pivot therewith.

20. The device of claim 19, wherein the ejecting means includes a cam member including first flange means for moving against the first module socketed in the first holding means in response to pivoting movement of the lever arm in a clockwise direction between its inactive position and first module-ejecting position and second flange means for moving against the second module socketed in the second holding means in response to pivoting movement of the lever arm in a counterclockwise direction between its inactive position and its second module-ejecting position.

21. The device of claim 20, wherein the lever arm includes first stop means for engaging the socket to limit pivoting movement of the lever arm in the clockwise direction and second stop means for engaging the socket to limit pivoting movement of the lever arm in the counterclockwise direction.

22. The device of claim 18, wherein the ejecting means includes a cam member and the rotating means includes a lever arm pivotably coupled to the socket for movement in clockwise and counterclockwise direction, and the cam member is coupled to the lever arm to pivot therewith.

23. The device of claim 22, wherein the cam member includes first flange means for moving the first module held in the first holding means to an ejected position in response to pivoting movement of the lever arm in the clockwise direction and second flange means for moving the second module held in the second holding means to an ejected position in response to pivoting movement of the lever arm in the counterclockwise direction.

24. The device of claim 22, wherein the rotating means includes a pivot post rotatably mounted on the socket, the cam member is positioned on one end of the pivot post to move in a first plane, and the lever arm is positioned on another end of the pivot post to move in a second plane in spaced-apart relation to the first plane.

25. An electrical interconnect device comprising a socket formed to include a first chamber for holding a first module therein and an adjacent second chamber for holding a second module therein, a lever arm pivotably mounted on the socket for movement from an inactive position to a first module-ejecting position and to a second module-ejecting position, a cam member coupled to the lever arm, the cam member being configured to disengage the first module from the first chamber in response to movement of the lever arm from the inactive position to the first module-ejecting position and to disengage the second module from the second chamber in response to movement of the lever arm from the inactive position to the second module-ejecting position.

26. The device of claim 25, wherein the cam member includes a first flange configured to disengage the first module from the first chamber and a second flange configured to disengage the second module from the second chamber.

27. The device of claim 25, wherein the lever arm includes a first stop surface for engaging the socket to limit pivoting movement of the lever arm in a counterclockwise direction.

28. The device of claim 25, further comprising a pivot post rotatable coupled to the socket, the cam member being coupled to one end of the pivot post to move in a first plane, and the lever arm being coupled to a second end of the pivot post to move in a second plane in spaced-apart relation to the first plane.

29. The device of claim 28, wherein the socket includes a base formed to include the first and second chambers therein, and an integral upstanding end piece on one end of the base, the end piece being formed to include a first channel for rotatably supporting an outer end of the pivot post and an inner channel for rotatably supporting an inner end of the pivot post.

30. A device of claim 28, further comprising a web coupled between the cam member and a central portion of the pivot post to support the cam member in a rigid relation relative to the pivot post.

31. The device of claim 25, wherein the cam member has a generally semicircular shape.

32. The device of claim 31, further comprising a pivot post rotatably mounted on the socket, a first end of the pivot post being coupled to the generally semicircular-shaped cam member and aligned substantially concentrically with the generally semicircular-shaped cam member, and a second end of the pivot post being coupled to the lever arm.

33. The device of claim 31, wherein the socket includes a base formed to include the first and second chambers therein, and further comprising a contoured channel formed in the base to support the semicircular-shaped cam member for rotation about the axis of rotation.

34. The device of claim 25, wherein the socket includes a base formed to include the first and second chambers therein and an integral upstanding end piece on one end of the base, the lever arm being coupled to the end piece.

35. The device of claim 34, wherein the socket also includes an internal support member formed between the first and second chambers spaced apart from the end piece, a first external beam for stabilizing the first module, and a second external beam for stabilizing the second module.

36. The device of claim 35, further comprising a pivot post rotatably coupled to the end piece of the socket, the cam member being coupled a first end of the pivot post located between the end piece and the internal support member.

37. An electrical interconnect device comprising a socket formed to include a first chamber for holding a first module therein and an adjacent second chamber for holding a second module therein, an ejector coupled to the socket, the ejector being movable from an inactive position to a first module-ejecting position and to a second module-ejecting position, the ejector being configured to disengage the first module from the first chamber in response to movement of the ejector from the inactive position to the first module-ejecting position and to disengage the second module from the second chamber in response to movement of the ejector from the inactive position to the second module-ejecting position.

38. The device of claim 37, wherein the cam member includes a first flange for ejecting the first module held in the first chamber in response to movement of the lever arm in a clockwise direction about the axis of rotation and a second flange for ejecting the second module held in the second chamber in response to movement of the lever arm in a counterclockwise direction about the axis of rotation.

39. The device of claim 38, wherein the lever arm includes a first stop surface for engaging the socket to limit movement of the lever arm in the clockwise direction and a second stop surface for engaging the socket to limit movement of the lever arm in the counterclockwise direction.

40. The device of claim 37, wherein the ejector includes a cam member, a lever arm coupled to the cam member, and means for coupling the lever arm to the socket so that the lever arm is rotatable in a first plane about an axis of rotation to move the cam member in a second plane spaced apart from the first plane.

41. The device of claim 40, wherein the socket includes a base formed to include the first and second chambers and an integral upstanding end piece on one end of the base, the lever arm being coupled to the end piece.

42. The device of claim 40, further comprising a pivot post rotatably mounted on the socket, the cam member being coupled to one end of the pivot post to move in a first plane, and the lever arm being coupled to a second end of the pivot post to move in a second plane in a spaced-apart relation to the first plane.

43. The device of claim 42, wherein the socket includes a base formed to include the first and second chambers therein, and an integral upstanding end piece on one end of the base, the end piece being formed to include a first channel for rotatably supporting an outer end of the pivot post and an inner channel for rotatably supporting an inner end of the pivot post.

44. A device of claim 42, further comprising a web coupled between the cam member and a central portion of the pivot post to support the cam member in a rigid relation relative to the pivot post.

45. The device of claim 40, wherein the cam member has a generally semicircular shape.

46. The device of claim 45, further comprising a pivot post rotatably mounted on the socket, a first end of the pivot coupled to the generally semicircular-shaped cam member and aligned substantially concentrically with the generally semicircular-shaped cam member and a second end of the pivot post being coupled to the lever arm.

47. The device of claim 46, wherein the socket includes a base formed to include the first and second chambers therein, and further comprising a contoured channel formed in the base to support the semicircular-shaped cam member for rotation about the axis of rotation.

* * * * *

UNITED STATES PATENT AND TRADEMARK OFFICE

CERTIFICATE OF CORRECTION

PATENT NO. :5,147,211

DATED :September 15, 1992

INVENTOR(S) :Tondreault, et al.

It is certified that error appears in the above-indentified patent and that said Letters Patent is hereby corrected as shown below:

The drawing figures consisting of figures 1 and 5, should be deleted to appear as per attached sheets.

UNITED STATES PATENT AND TRADEMARK OFFICE

CERTIFICATE OF CORRECTION

PATENT NO. : 5,147,211

DATED : September 15, 1992

INVENTOR(S) : Tondreault et al.

It is certified that error appears in the above-identified patent and that said Letters Patent is hereby corrected as shown below:

In Fig. 1, insert --41-- as indicated in red on the drawing submitted herewith;

In Fig. 5, insert --41-- as indicated in red on the drawing submitted herewith;

In column 4, line 29, change "6" to --26--;

In column 4, line 33, change "20" to --22--;

In column 4, line 52, change "40" to --10--;

In column 5, line 24, change "use" to --user--;

In column 5, line 33, after "this" insert --position, the first ejector flange 56 abuts against a--;

In column 5, line 35, change "on" to --of--;

In column 5, line 60, change "vertical" to --pivotable--; and

In column 6, line 25, delete "12".

Signed and Sealed this

Thirtieth Day of May, 1995

*Attest:*

Bruce Lehman

BRUCE LEHMAN

*Attesting Officer*

*Commissioner of Patents and Trademarks*